US005564299A

United States Patent [19]

Burns et al.

[11] Patent Number: 5,564,299

[45] Date of Patent: Oct. 15, 1996

[54] WIRE STRAIGHTENING APPARATUS WITH LONG-LIFE DIES

[75] Inventors: Irvin Burns, Walloon Lake; Patrick Robbins, Petoskey, both of Mich.; Michael J. Yankaitis, Roscoe, Ill.

[73] Assignee: Rockford Manufacturing Group, Inc., Roscoe, Ill.

[21] Appl. No.: 259,244

[22] Filed: Jun. 13, 1994

[51] Int. Cl.[6] ..... B21D 3/06

[52] U.S. Cl. ..... 72/79; 140/147

[58] Field of Search ..... 140/147, 140; 72/79, 160

[56] References Cited

U.S. PATENT DOCUMENTS

| | | | |
|---|---|---|---|
| 33,707 | 11/1861 | Kaiser . | |
| 149,666 | 4/1874 | Mallett . | |
| 277,267 | 5/1883 | Goodyear et al. . | |
| 293,212 | 1/1884 | Angstrom . | |
| 456,883 | 7/1891 | Brightman . | |
| 872,346 | 12/1907 | Harter . | |
| 1,012,964 | 12/1911 | Ashcroft . | |
| 1,044,899 | 11/1912 | McLean . | |
| 1,473,256 | 11/1923 | Shuster | 140/147 |
| 2,369,329 | 2/1945 | Wennerberg | 140/147 |
| 3,335,764 | 8/1967 | Pilling | 140/147 |
| 3,742,747 | 7/1973 | Fulcushima et al. | 72/79 |
| 4,177,843 | 12/1979 | Sarver | 140/147 |
| 4,391,307 | 7/1983 | Levi et al. | 140/140 |
| 4,920,776 | 5/1990 | Denzler | 72/79 |

*Primary Examiner*—Lowell A. Larson
*Assistant Examiner*—Gene L. Kim
*Attorney, Agent, or Firm*—Leydig, Voit & Mayer, Ltd.

[57] ABSTRACT

Wire is straightened as an incident to being pulled through axially spaced upstream, intermediate and downstream straightening dies carried within a rotating arbor. Each die is formed with a groove which is specially shaped to cause the wire to tend to follow its natural path as the wire is straightened, the shape of the grooves reducing high stress concentrations on the dies and increasing the service life thereof.

8 Claims, 1 Drawing Sheet

A
X
Y
D
W
R-1
R-2
R-3
C-1
C-2
C-3

WIRE STRAIGHTENING APPARATUS WITH LONG-LIFE DIES

BACKGROUND OF THE INVENTION

This invention relates generally to apparatus for straightening wire and, more particularly, to apparatus for straightening a length of wire which has been wound in a coil and which is to be cut into shorter pieces.

Even more specifically, the invention relates to wire straightening apparatus which, in general principle, is similar to that disclosed in Angstrom U.S. Pat. No. 293,212. In the apparatus of the Angstrom patent, wire is fed through a rotating mandrel or arbor having upstream and downstream straightening dies and having an intermediate straightening die located between the upstream and downstream dies. In order to control the angular bend or strain imparted to the wire as the wire threads through dies, the upstream and downstream dies are supported for selective axial adjustment toward and away from one another while the intermediate die is supported for selective adjustment radially of the upstream and downstream dies.

To the best of the present inventors' knowledge, wire straightening machines of the type disclosed in the Angstrom patent are not being—and may never have been—used commercially by others. The inventors have recognized, however, that the principle taught by the Angstrom patent is superior to that incorporated in wire straightening machines which are in fact in present commercial use. In attempting to incorporate the Angstrom principle into a commercially viable machine, the inventors encountered a significant problem in that straightening dies of the type disclosed by Angstrom tend to wear quickly and thus experience an unacceptably short service life.

SUMMARY OF THE INVENTION

The general aim of the present invention is to provide a commercially acceptable wire straightening machine of the above type and specifically to provide a machine in which the straightening dies are subjected to less wear and are capable of functioning over relatively long periods.

A more detailed object of the invention is to achieve the foregoing by providing a wire straightening machine in which the dies are configured so as to allow the wire to substantially follow its natural path as the wire is straightened and thereby eliminate stress concentration on particular areas of the dies.

These and other objects and advantages of the invention will become more apparent from the following detailed description when taken in conjunction with the accompanying drawings.

Figures 1, 2, 3, 4, 5, 6, 7, 8:
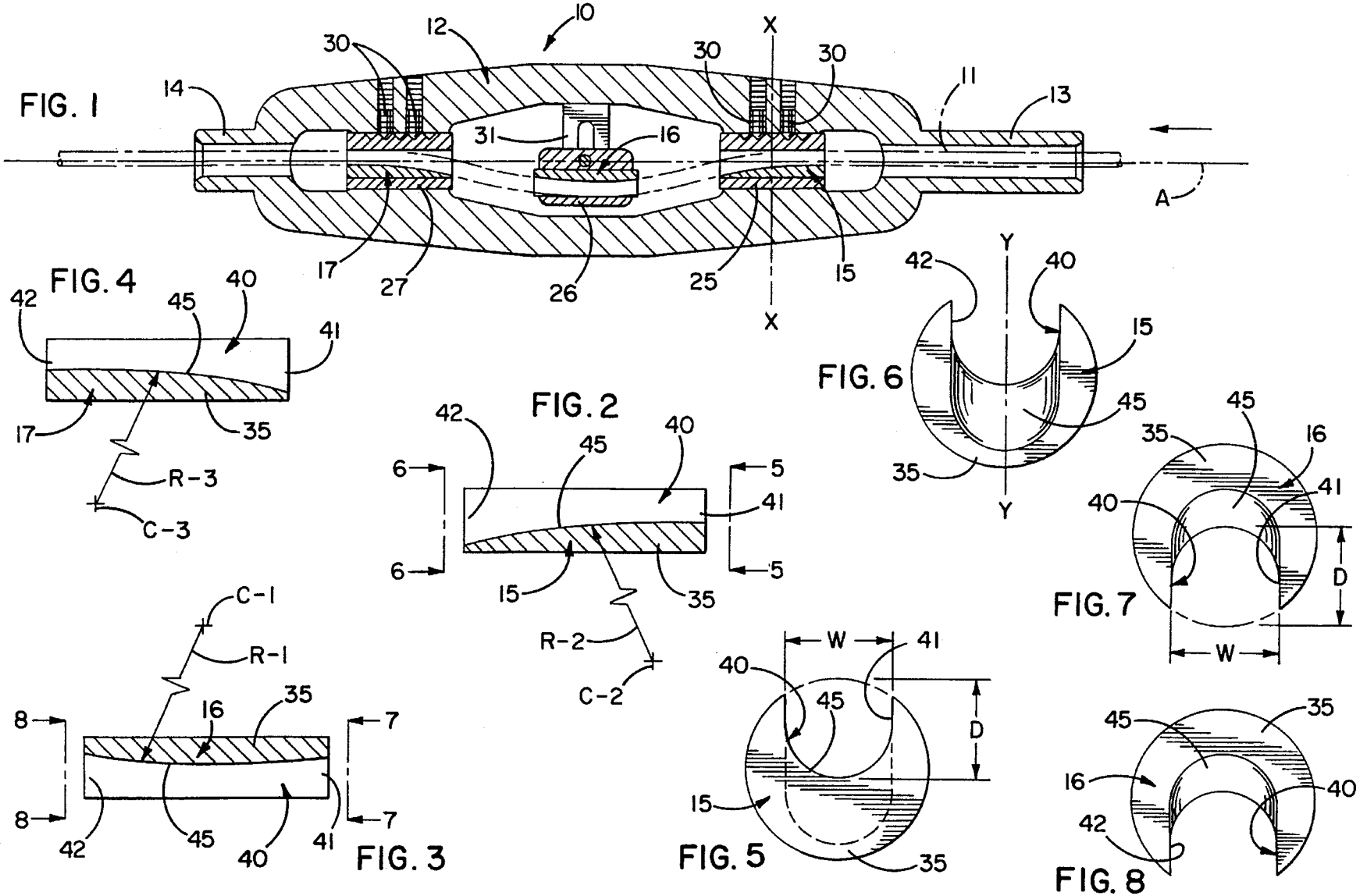
FIG. 1 is a cross-sectional view taken axially through an arbor equipped with new and improved wire straightening dies incorporating the unique features of the present invention.
FIGS. 2, 3 and 4 are enlarged views of the upstream, intermediate and downstream dies, respectively, shown in FIG. 1.
FIGS. 5 and 6 are enlarged end views as seen along the lines 5—5 and 6—6, respectively, of FIG. 2.
FIGS. 7 and 8 are enlarged end views as seen along the lines 7—7 and 8—8, respectively, of FIG. 3.

While the invention is susceptible of various modifications and alternative constructions, a certain illustrated embodiment hereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE PREFERRED EMBODIMENT

As shown in the drawings for purposes of illustration, the invention is embodied in apparatus 10 for straightening a length of wire 11 after the wire has been unwound from a coil (not shown) and before the wire is cut into shorter pieces. Only so much of the apparatus as is necessary to an understanding of the present invention has been illustrated since wire straighteners per se are well known in the art.

Basically, the apparatus 10 comprises a hollow arbor 12 adapted to be rotated continuously about a predetermined axis A coinciding with the central axis of the arbor. Wire 11 is fed through the arbor as the latter is rotated. The arbor includes a tubular neck 13 at its upstream entrance end and a somewhat shorter tubular neck 14 at its downstream exit end. As the wire is threaded through the arbor, it is straightened by the action of an upstream die 15, an intermediate die 16, and a downstream die 17. The intermediate die 16 is located approximately midway between the upstream and downstream dies 15 and 17 and is offset radially from those dies so as to cause the wire to follow a curved path as it proceeds through the central portion of the arbor 12.

The upstream and downstream dies 15 and 17 are located within the cylindrical bores of holders or sleeves 25 and 27, respectively, and are secured releasably to the sleeves by set screws (not shown). The intermediate die is secured within the cylindrical bore of a sleeve 26 by a similar set screw. To compensate for different wire conditions, the sleeves 25 and 27 are supported for selective axial adjustment within the arbor 12 and are adapted to be releasably secured in fixed positions by set screws 30. The sleeve 26 is supported for radial adjustment by a slotted bracket 31 in the arbor and is adapted to be adjusted to and held in a fixed radial position by set screws (not shown).

In accordance with the present invention, the dies 15, 16 and 17 are specially configured to straighten the wire 11 while allowing the wire to substantially follow its natural path as the wire passes through the arbor 12. By virtue of the configuration of the dies, stress imposed on the dies by the wire is distributed more uniformly along the dies so as to reduce areas of high stress concentration and wear and thereby increase the service life of the dies.

More specifically, each of the dies 15, 16 and 17 is made from a cylindrical rod 35 of gray iron. In this particular instance, each rod 35 has a length of approximately 2¼" and an outside diameter of approximately ⅝". The rods fit snugly but removably within the sleeves 25, 26 and 27.

In carrying out the invention, the rod 35 of each of the dies 15, 16 and 17 is formed with a uniquely shaped groove 40 through which the wire 11 threads as the wire is fed through the arbor 12. Each groove is generally U-shaped, has an entrance end 41 and an exit end 42. Each groove further includes a bottom 45 which curves arcuately and concavely in a first plane X—X (FIG. 1) disposed perpendicular to the axis A and convexly in a second plane Y—Y (FIG. 6)

disposed perpendicular to the plane X—X and containing the axis A. The convex curvature, however, of the groove bottoms is different for each of the dies 15, 16 and 17.

Specifically, the bottom 45 of the groove 40 of the intermediate die 16 curves convexly and symmetrically about a point located midway between the entrance and exit ends 41 and 42 of the groove. The bottom of the groove defines an arc having a radius R-1 (FIG. 3) and struck about a center C-1 lying in the plane Y—Y and located equidistantly from the ends of the groove.

The bottom 45 of the groove 40 of the upstream die 15 curves convexly and substantially symmetrically relative to a point located nearer to the entrance end 41 of such groove than to the exit end 42 thereof. The bottom of the upstream die groove defines an arc having a radius R-2 (FIG. 2) struck about a center C-2 which also lies in the plane Y—Y but which, in this particular instance, is spaced only ½" from the entrance end 41 of the groove and 1¾" from the exit end 42 of the groove.

Conversely, the bottom 45 of the groove 40 of the downstream die 17 curves convexly and substantially symmetrically relative to a point located nearer to the exit end 42 of such groove than to the entrance end 41 thereof. As shown in FIG. 4, the bottom 45 of the groove 40 of the downstream die 17 defines an arc having a radius R-3 and struck about a center C-3 lying in the plane Y—Y, the center C-3 herein being spaced ½" from the exit end 42 of the groove and 1¾" from the entrance end 41 of the groove.

In use, the dies 15, 16 and 17 are positioned angularly in the sleeves 25, 26 and 27, such that the groove 40 of the intermediate die 16 is spaced 180 degrees from the grooves of the upstream and downstream dies 15 and 17 (see FIG. 1). As the arbor 12 is rotated and as the wire 11 is pulled through the dies, the grooves in the dies guide the wire and cause the wire to follow the path shown in FIG. 1, the wire contacting the grooves but not contacting the inner sides of the sleeves and being straightened by the action of the dies. The illustrated path closely approximates the natural path which the wire tends to follow upon being straightened and thus the dies are subjected to less stress and wear than otherwise is the case when the wire is fed through a die with a cylindrical bore. By adjusting the intermediate die 16 radially away from the axis A, the straightening action may be made more aggressive if necessary to accommodate wire initially wound in a relatively tight coil. The straightening action may be made even more aggressive by adjusting the die 15 and/or the die 17 axially toward the die 16 and may be reduced by shifting the dies 15 and 17 away from the die 16.

Differently sized dies 15, 16 and 17 are required for different ranges of wire diameters. Dies have been designed to handle wire ranging in diameter from 0.100" through 0.340", the rod 35 of the die in each case having an outside diameter of about ⅝". For dies capable of straightening wire having a diameter range of 0.100"–0.130", each of the radii R-1, R-2 and R-3 herein has a dimension of 4.0" while, for wire having a diameter range of 0.310"–0.340" each of the aforementioned radii has a dimension of 7.5". The depth and width of the grooves also must be correlated with the wire diameter. For wire ranging in diameter from 0.100"–0.130", each groove 40 has a constant width W of about 0.188" and has a depth D of about 0.163" at the shallowest part of the groove. For wire ranging in diameter from 0.310"–0.340", the values of W and D are 0.375" and 0.350", respectively.

We claim:

1. Apparatus for straightening wire, said apparatus comprising a hollow arbor adapted to be rotated about a predetermined axis and having an upstream entrance end and a downstream exit end; said wire being adapted to be fed through said arbor from said entrance end to said exit end during rotation of said arbor about said axis; upstream, downstream and intermediate dies located within and rotatable with said arbor; said intermediate die being located between and spaced axially from said upstream and downstream dies; each of said dies having a generally U-shaped groove through which said wire threads as the wire is fed through said arbor; each of said grooves having entrance and exit ends and having a bottom which curves concavely in a first plane perpendicular to said axis and convexly in a second plane containing said axis and disposed perpendicular to said first plane; the bottom of said groove in said intermediate die convexly curving substantially symmetrically relative to a point located substantially midway between the ends of such groove; the bottom of said groove in said upstream die convexly curving substantially symmetrically relative to a point located nearer to the entrance end of such groove than to the exit end thereof; and the bottom of said groove in said downstream die curving substantially symmetrically relative to a point located nearer to the exit end of such groove than to the entrance end thereof; the bottom of the groove in said intermediate die being oriented approximately 180 degrees with respect to said axis from the bottoms of the grooves in said upstream and downstream dies, the spacing of said points with respect to their respective grooves creating a natural path for said wire in which said wire is guided to enter the upstream die and exit the downstream die substantially parallel to the predetermined axis, and in which the exit of the upstream die and the entrance of the downstream die cooperate with the symmetrical curve of the intermediate die to form a smooth, natural curved path for guidance of the wire.

2. Apparatus for straightening wire, said apparatus comprising a hollow arbor adapted to be rotated about a predetermined axis and having an upstream entrance end and a downstream exit end; said wire being adapted to be fed through said arbor from said entrance end to said exit end during rotation of said arbor about said axis; upstream, downstream and intermediate dies located within and rotatable with said arbor; said intermediate die being located between and spaced axially from said upstream and downstream dies; each of said dies having a generally U-shaped groove through which said wire threads as the wire is fed through said arbor; each of said grooves having entrance and exit ends and having a bottom which curves concavely in a first plane perpendicular to said axis and which defines a convex arc in a second plane containing said axis and disposed perpendicular to said first plane; the convex arc defined by the bottom of said groove in said intermediate die being struck about a center lying in said second plane and located substantially midway between the ends of such groove; the convex arc defined by the bottom of said groove in said upstream die being struck about a center lying in said second plane and located nearer to the entrance end of such groove than to the exit end thereof; and the convex arc defined by the bottom of said groove in said downstream die being struck about a center lying in said second plane and located nearer to the exit end of such groove than to the entrance end thereof; the bottom of the groove in said intermediate die being oriented approximately 180 degrees with respect to said axis from the bottoms of the grooves in said upstream and downstream dies, the spacing of the centers with respect to their respective grooves creating a natural path for said wire in which said wire is guided to enter the upstream die and exit the downstream die substantially parallel to the predetermined axis, and in which the exit of the upstream die and the entrance of the downstream die cooperate with the symmetrical curve of the intermediate die to form a smooth, naturally curved path for guidance of the wire.

3. Apparatus as defined in claim 2 in which the arcs defined by the bottoms of the grooves of said upstream and downstream dies are of substantially equal predetermined radii.

4. Apparatus as defined in claim 3 in which the arc defined by the bottom of the groove of said intermediate die is of a radius substantially equal to said predetermined radii.

5. Apparatus as defined in claim 2 further including upstream, downstream and intermediate generally cylindrical sleeves secured to said arbor, said dies being telescoped into and being substantially surrounded by said sleeves.

6. Apparatus as defined in claim 5 further including means supporting said intermediate sleeve for selective adjustment radially of said arbor.

7. Apparatus as defined in claim 6 further including means supporting said upstream and downstream sleeves for independent selective adjustment axially of said arbor.

8. Apparatus as defined in claim 5 further including means supporting said upstream and downstream sleeves for independent selective adjustment axially of said arbor.

* * * * *